US011125151B2

(12) United States Patent
Johansson

(10) Patent No.: US 11,125,151 B2
(45) Date of Patent: Sep. 21, 2021

(54) WIRELESS CONTROL OF ACTUATED VALVE IN VARIABLE COMPRESSION RATIO PISTON

(71) Applicant: KING ABDULLAH UNIVERSITY OF SCIENCE AND TECHNOLOGY, Thuwal (SA)

(72) Inventor: Bengt Håkan Johansson, Thuwal (SA)

(73) Assignee: KING ABDULLAH UNIVERSITY OF SCIENCE AND TECHNOLOGY, Thuwal (SA)

( * ) Notice: Subject to any disclaimer, the term of this patent is extended or adjusted under 35 U.S.C. 154(b) by 0 days.

(21) Appl. No.: 16/975,664

(22) PCT Filed: Feb. 25, 2019

(86) PCT No.: PCT/IB2019/051509

§ 371 (c)(1),
(2) Date: Aug. 25, 2020

(87) PCT Pub. No.: WO2019/175696

PCT Pub. Date: Sep. 19, 2019

(65) Prior Publication Data

US 2020/0408145 A1 Dec. 31, 2020

Related U.S. Application Data

(60) Provisional application No. 62/643,384, filed on Mar. 15, 2018.

(51) Int. Cl.
*F02B 75/04* (2006.01)
*F01M 11/02* (2006.01)
(Continued)

(52) U.S. Cl.
CPC ..... *F02B 75/044* (2013.01); *F01M 11/02* (2013.01); *F02B 75/30* (2013.01); *F02D 15/04* (2013.01); *F02D 41/009* (2013.01)

(58) Field of Classification Search
CPC ..... F02B 75/044; F02B 75/30; F01M 11/02; F02D 15/04; F02D 41/009
(Continued)

(56) References Cited

U.S. PATENT DOCUMENTS

2010/0139479 A1* 6/2010 Pirault ..... F02B 75/044 92/181 P
2011/0226220 A1* 9/2011 Wilkins ..... F16J 7/00 123/48 B
2015/0316020 A1* 11/2015 Schuele ..... F02P 5/153 123/406.41

FOREIGN PATENT DOCUMENTS

DE 102007040699 A1 3/2009
DE 202011107187 U1 2/2013
(Continued)

OTHER PUBLICATIONS

Ashley, C., "Variable Compression Pistons," SAE International, SAE Technical Paper Series, Paper 901539, Aug. 1, 1990, 15 pages.
(Continued)

*Primary Examiner* — Lindsay M Low
*Assistant Examiner* — Omar Morales
(74) *Attorney, Agent, or Firm* — Patent Portfolio Builders PLLC

(57) ABSTRACT

A telescopic piston for use with an internal combustion engine includes an inner piston; an outer piston located over the inner piston; an upper oil chamber formed between the inner piston and the outer piston; and an actuated valve having a controllable peak pressure that opens the actuated valve. A value of the peak pressure is wirelessly received at the telescopic piston.

21 Claims, 9 Drawing Sheets

(51) Int. Cl.
*F02B 75/30* (2006.01)
*F02D 15/04* (2006.01)
*F02D 41/00* (2006.01)

(58) Field of Classification Search
USPC ..... 123/48 B
See application file for complete search history.

(56) References Cited

FOREIGN PATENT DOCUMENTS

| | | | |
|---|---|---|---|
| DE | 102016115765 | A1 | 3/2018 |
| JP | H11117779 | A | 4/1999 |
| WO | 8601562 | A1 | 3/1986 |

OTHER PUBLICATIONS

Boggs, D.L., et al., "The Otto-Atkinson Cycle Engine-Fuel Economy and Emissions Results and Hardware Design," SAE International, SAE Technical Paper Series, Paper 950089, Feb. 1, 1995, 15 pages.
Roberts, M., "Benefits and Challenges of Variable Compression Radio (VCR)," SAE International, SAE Technical Paper Series, Paper 2003-01-0398, Mar. 3, 2003, 13 pages.
International Search Report in corresponding/related International Application No. PCT/IB2019/051509, dated Apr. 30, 2019.
Written Opinion of the International Searching Authority in corresponding/related International Application No. PCT/IB2019/051509, dated Apr. 30, 2019.

* cited by examiner

WIRELESS CONTROL OF ACTUATED VALVE IN VARIABLE COMPRESSION RATIO PISTON

CROSS-REFERENCE TO RELATED APPLICATIONS

This application is a U.S. National Stage Application of International Application No. PCT/IB2019/051509, filed on Feb. 25, 2019, which claims priority to U.S. Provisional Patent Application No. 62,643,384, filed on Mar. 15, 2018, entitled "VARIABLE COMPRESSION RATIO PISTON (VCR-PISTON)," the disclosure of which is incorporated herein by reference in its entirety.

BACKGROUND

Technical Field

Embodiments of the subject matter disclosed herein generally relate to controlling a peak pressure that opens a valve for a variable compression ratio piston, and more specifically, to an internal combustion engine that uses a wireless control for the peak pressure of an actuated valve located in the variable compression ratio piston.

Discussion of the Background

Internal combustion engines operate by compressing a fuel charge before combustion. This compression is described by the compression ratio, which is defined as the ratio of a maximum volume to a minimum volume in the cylinder of the engine, i.e., Vmax/Vmin. Most engines use a fixed compression ratio, normally 10:1 to 14:1 for gasoline engines and 14:1 to 18:1 for diesel engines. However, the optimum compression ratio for such engines is not constant while the engine is running, but rather it changes with the operating conditions and the fuel used. This means that most engines today operate for some extended periods of time with a compression ratio that is not optimal. Operating at a non-optimal compression ratio means that the burning of the fuel generates more pollutants than necessary, and the engine uses more fuel than required, which results in unnecessary pollution and ultimately global warming.

To deal with the increasingly rigorous challenges arising from environment pollutions and global warming status quo, it becomes more and more imperative to develop competitive Internal Combustion Engine (ICE) technologies with higher fuel efficiency and less pollution, without sacrificing the brake power and other vehicle performances. Among these new technologies researched in recent years, the Variable Compression Ratio (VCR) technology has been considered as a promising method to improve the engine thermal efficiency, and fuel economy while reducing the emissions.

During engine operation, a higher compression ratio leads to a higher thermal efficiency, especially under partial load, as is shown in FIG. 1 (which shows the thermal efficiency on the Y axis versus the compression ratio on the X axis for various ratios R of the specific heat at constant pressure and the temperature of the gas in the cycle). However, while increasing the compression ratio, an abnormal combustion, such as the knock, brought by the high temperature, may cause engine damage, which should be avoided at high loads.

Efforts have been made over the years in the VCR field, but with limited success. In 1992, Ford company presented a variable compression ratio methodology with an auxiliary chamber in the cylinder head. In 2005, Saab company introduced a Saab Variable Compression (SVC) engine, whose cylinder head could be tilted to achieve variable compression ratio. With regard to this design, the SVC engine was reported to be able to decrease fuel consumption by 30%, and HC emissions were also decreased significantly. In addition, the Nissan company had launched the first production VCR engine, which adopted a multi-link connecting rod, which could change the compression ratio between 8:1 and 14:1 in a flexible way. This approach claimed a 27% better fuel economy than a normal engine running at roughly the same power and torque. However, this kind of design still needs to overcome massive oscillating forces and rotating forces. Besides, many other mechanisms have been proposed to change the eccentric pin of the crankshaft, though it requires a significant adjustment of the engine body.

Moreover, some VCR technologies with variable piston height had also been proposed, for example, by Honda company, which suggested a Dual Piston Mechanism with compact structure and fast response time. The fuel economy for such configuration was claimed to be about 6%. Similarly, a pressure reactive piston technology, with a Belleville spring pack installed between the piston crown and the inner piston, had been proposed. This mechanism effectively limited the peak cylinder pressures at high loads, while allowing the engine to operate at high compression ratios under low loads.

Still another VCR technology focused on varying the piston deck height, which offers an attractive route to VCR engine production since it requires relatively minor changes to the engine configuration [1, 2]. As for the height adaptation piston, many efforts had been put on it before and some innovations had been presented, for example, a two-piece, hydraulically actuated piston invented by the British Internal Combustion Engine Research Institute (BICERI) in 1959 [3].

However, this configuration has a set peak pressure during the entire cycle of the engine, which is very limiting. Thus, there is a need for an engine and technology that allows to adjust not only the compression ratio of the engine, but also the peak pressure associated with a piston having a variable height.

SUMMARY

According to an embodiment, there is a telescopic piston for use with an internal combustion engine. The telescopic piston includes an inner piston, an outer piston located over the inner piston, an upper oil chamber formed between the inner piston and the outer piston, and an actuated valve having a controllable peak pressure that opens the actuated valve. A value of the peak pressure is wirelessly received at the telescopic piston.

According to another embodiment, there is an internal combustion engine that includes a wireless transmitter, a cylinder, and a telescopic piston located inside the cylinder, the telescopic piston having an actuated valve. A peak pressure of the actuated valve is received wirelessly from the transmitter.

According to still another embodiment, there is a method for adjusting a peak pressure of an actuated valve in a telescopic piston of an engine. The method includes receiving at a receiver of the telescopic piston a signal in a wireless manner, wherein the signal is indicative of the new peak pressure; and replacing a current peak pressure of the actuated valve with the new peak pressure.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a telescopic piston that is used in an engine. However, the embodiments discussed herein may be applied to other pistons than a telescopic piston.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, there is an engine that has a telescopic piston. The outer part of the telescopic piston can move up and down relative to the inner part of the telescopic piston so that a variable compression ratio can be achieved. Further, a peak pressure during a cycle can be adjusted with a wireless system.

Figure 1:
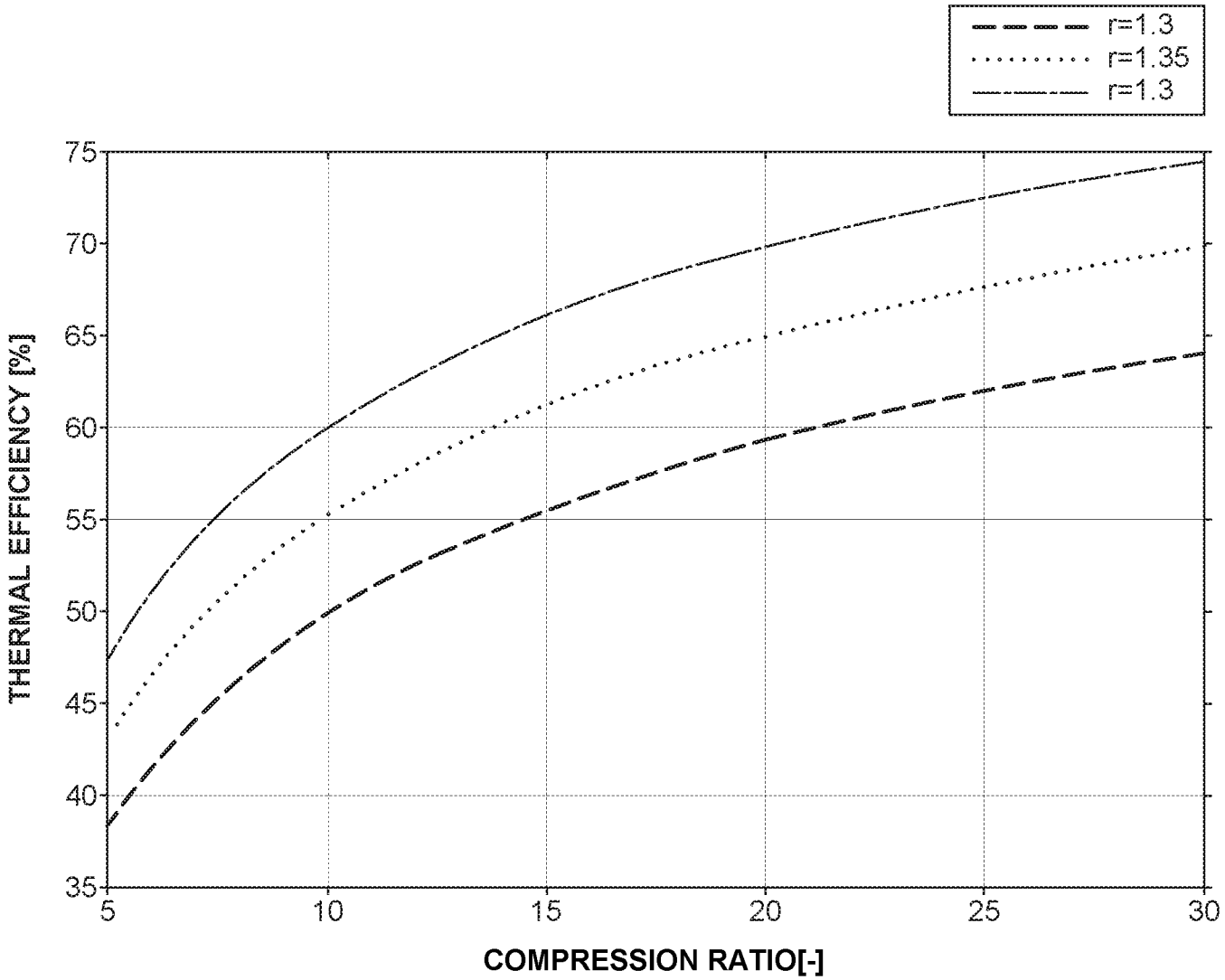
FIG. 1 illustrates the thermal efficiency of an internal combustion engine as a function of the compression ratio.
Figure 2:
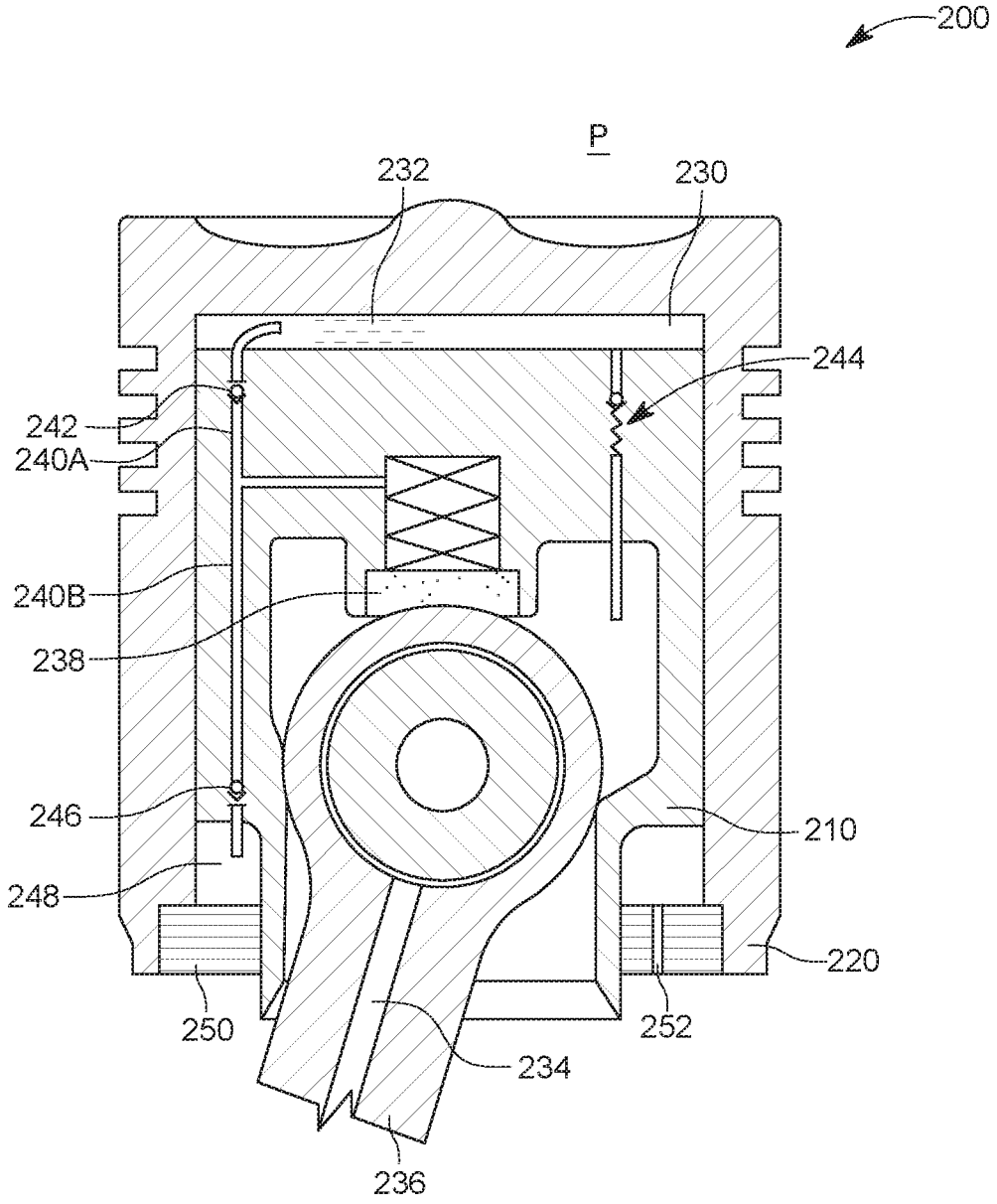
FIG. 2 illustrates a telescopic piston having a check valve with a set peak pressure.

Prior to discussing this telescopic piston with an adjustable peak pressure in more detail, an engine with a telescopic piston having a fixed peak pressure is first discussed with regard to FIG. 2. Telescopic piston 200 has an inner piston 210 and an outer piston 220. An upper oil chamber 230 is defined between the inner and outer pistons. Oil 232 is fed from the oil system of the engine, through a passage 234 formed in a connecting rod 236 that is connected to the inner piston. The connecting rod 236 moves the telescopic piston 200 up and down inside its corresponding cylinder. The connecting rod is also connected to the crankshaft (not shown) of the engine. The oil is stored in an oil collection chamber 238. From here, the oil is fed along a passage 240A to a one-way valve 242, which allows the oil to enter the upper oil chamber 230. When the pressure P above the outer piston 220 is larger than the preset peak pressure, the check valve 244 opens and the oil 232 from the upper oil chamber 203 is forced through the check valve 244 into the oil collection reservoir (not shown) of the engine. The oil from the oil collection chamber 238 is also moving through another passage 240B to a one way valve 246, into a lower oil chamber 248. The lower oil chamber 248 is formed between the outer piston, the inner piston, and a lower oil chamber closing ring 250. A passage 252 may be formed in the oil chamber closing ring 250 to allow the oil to leak back into the collection oil reservoir of the engine.

In operation, at the end of the exhaust stroke, and at the beginning of the intake stroke, the net upward forces acting on the telescopic piston cause a small movement upwards of the outer piston 220. This difference in the relative movement is controlled by the reduction of the lower oil chamber, which results from the expulsion of the oil through the passage 252. The additional volume enlarges the upper oil chamber 230 and this volume will be filled with oil 232 coming through the one way valve 242. Therefore, the compression height (relative movement) increases over the number of cycles, but is restricted by the mechanical limit provided by the closing. The passage 252 is designed to ensure that the outer piston 220 will not move upward relative to the inner piston 210 more than a small limit during each stroke.

During the firing stroke, the cylinder pressure P increases dramatically and exceeds the design limit determined by the cracking pressure of the check valve 244, and thus, the upper oil chamber 230 discharges the oil 232 and reduces its volume, and the outer piston 220 moves down relative to the inner piston 210. This action will also cause the lower oil chamber 248 to expand and be filled by oil through the one way valve 246. Therefore, the amount of the oil discharged during compression/expansion strokes depends on the set peak pressure of the check valve 244.

Figure 3:
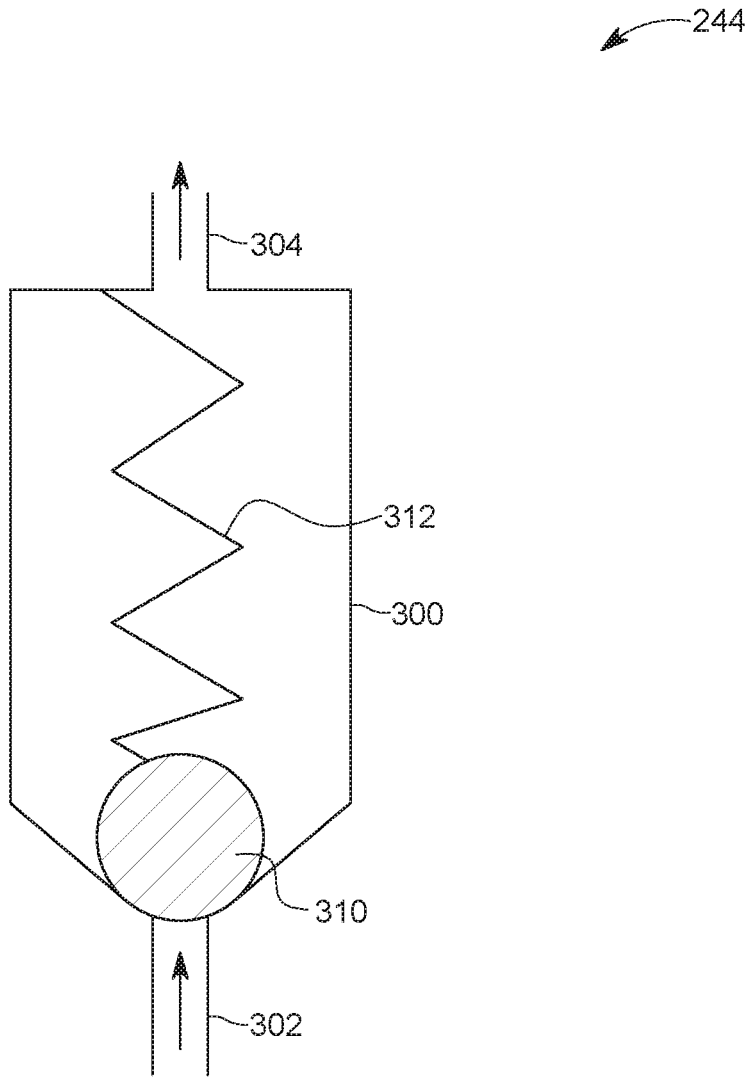
FIG. 3 illustrates a check valve with a set peak pressure.

One possible implementation of the check valve 244 is shown in FIG. 3. The check valve 244 includes a housing 300 having an input 302 and an output 304. Oil enters at the input 302. However, a ball 310, which is biased by a spring 312 against the input 302, blocks the oil from flowing through the valve. The elastic force applied by the spring 312 defines the pressure (set peak pressure) at which the valve starts opening up and allowing the oil at the input 302 to travel through the housing 300 towards the output 304. This opening pressure is the set peak pressure mentioned in the embodiment discussed with regard to FIG. 2. The peak pressure is constant, i.e., once a certain spring 312 is installed in the valve, the peak pressure is given by the characteristics of that spring. This means that unless the peak pressure is reached in the upper oil chamber 230 in FIG. 2, this valve stays shut and no oil moves past it, irrespective of that load or needs of the engine.

Figure 4:
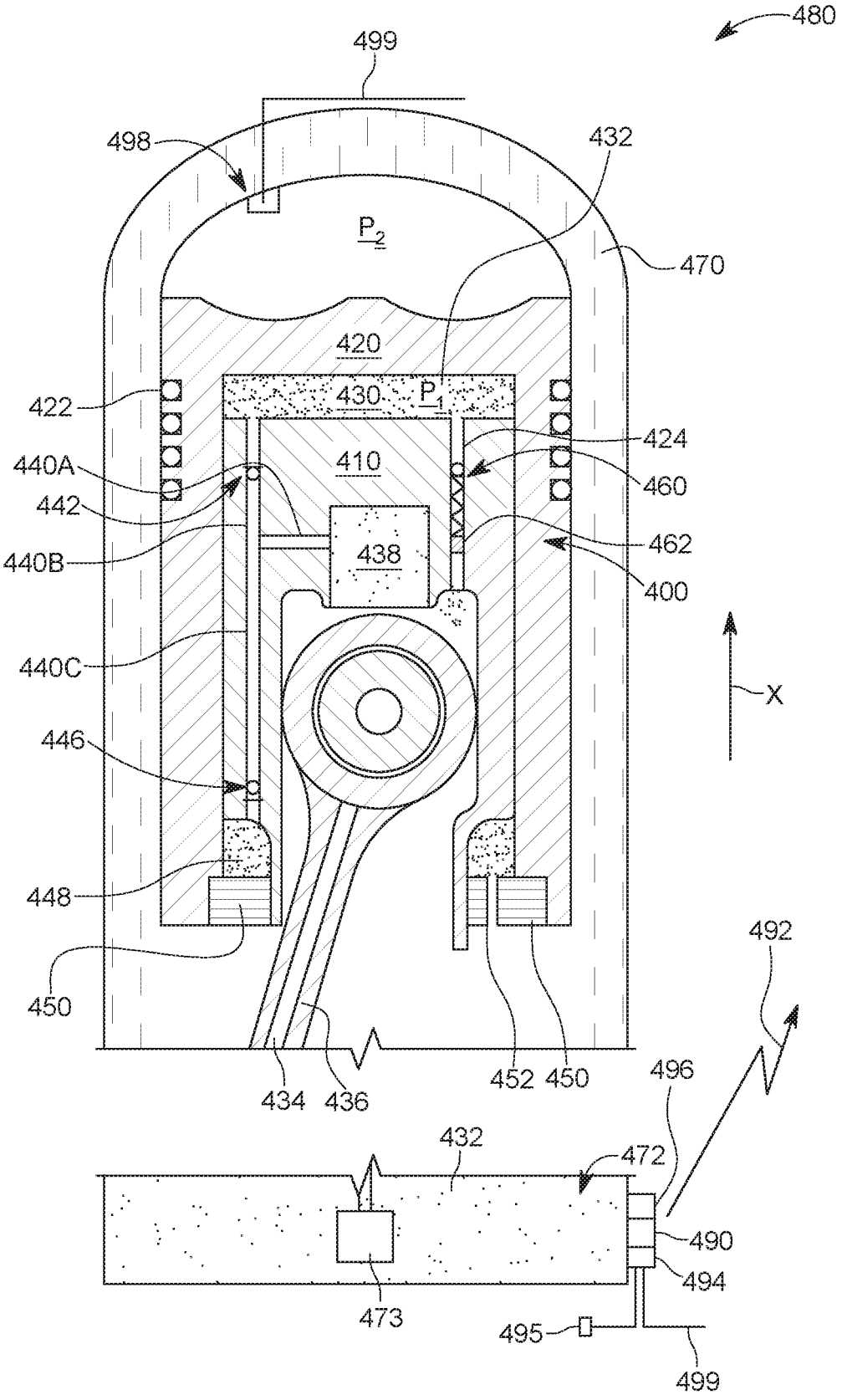
FIG. 4 illustrates a telescopic piston having an actuated valve with an adjustable peak pressure.

According to an embodiment illustrated in FIG. 4, a telescopic piston 400 is provided with an actuated valve that has an adjustable peak pressure. The peak pressure can be changed remotely, for example, through wireless communication between a receiver associated with the actuated valve and a transmitter associated with the engine. The transmitter has a global controller that measures one or more parameters of the engine and based on these measurements, decides to change the peak pressure of the actuated valve. The new value for the peak pressure is transmitted in a wireless manner to the actuated valve and the actuated valve replaces the current peak pressure with a new peak pressure, in effect, controlling its peak pressure. This adjustment can happen as fast as the duration of one stroke. In one application, each cylinder in the engine has a corresponding actuated valve with corresponding wireless communication so that the peak pressure of each telescopic piston can be adjusted/controlled independent of the others.

FIG. 4 shows the telescopic piston 400 placed inside a cylinder 470 of an engine 480. The engine can have plural cylinders and plural corresponding telescopic pistons. An oil reservoir 471 for the entire engine is also shown. The oil 432 from the engine oil reservoir 472 moves along a passage 434, formed in the connecting link 436 and arrives at oil collection chamber 438. From here, the oil moves along passages 440A and 440B to the one way valve 442 and then into the upper oil chamber 430, formed between the inner piston 410 and the outer piston 420. O-rings 422 may be provided between the inner and outer pistons so that the oil from the upper oil chamber does not escape at the interface between the inner and outer pistons. The outer piston 420 can move along axis X relative to the inner piston 410, so that a variable compression ratio may be obtained.

Oil 432 from the upper oil chamber 430 can move along passage 424, formed in the inner piston 410, through actuated valve 460, when a certain pressure P1 inside the upper oil chamber 430 is larger than a set peak pressure of the actuated valve 460. The oil 432, when the pressure is larger than the set peak pressure, returns to the oil engine reservoir 472.

Oil from the oil collection chamber 438 can also advance along passages 440A and 440C to the one way valve 446, and then enters a lower oil chamber 448. The lower oil chamber 448 is defined by the inner piston, the outer piston and a closing ring 450. Closing ring 450 may have a passage 452 for leaking the oil back to the engine oil reservoir 472.

The actuated valve 460 is associated (may include) a receiver 462 for receiving, in a wireless manner, a signal 492 generated by a transmitter 490. Transmitter 490 is located within the interior of the engine 480 and is connected to a global controller 494 and a power source 496. The global controller and power source may be located anywhere inside or outside the engine. The global controller 494 can be programmed by the operator of the engine to send the signal 492 to the receiver 462 at any desired time and as often as the receiver can do it. The signal 492 may include a set peak pressure value for the actuated valve 460, i.e., a pressure at which the actuated valve should open and allow the oil 432 to flow from the upper oil chamber 430 to the reservoir 472.

The global controller 494 is also connected to one or more sensors. For example, it is possible to have a pressure sensor 498 placed inside the cylinder 470 (or other location) for measuring a pressure P2 inside the space between the cylinder 470 and the telescopic piston 400. In one embodiment, the pressure sensor 498 is wired to the global controller 494 by wire 499. The global controller 494 may also be connected to an angle sensor 495 that reads a crankshaft angle. Other sensors may be linked to the global controller for receiving other parameters of the engine, for example, temperature sensor, fuel composition sensor, air intake sensor, etc.

Figure 5A:
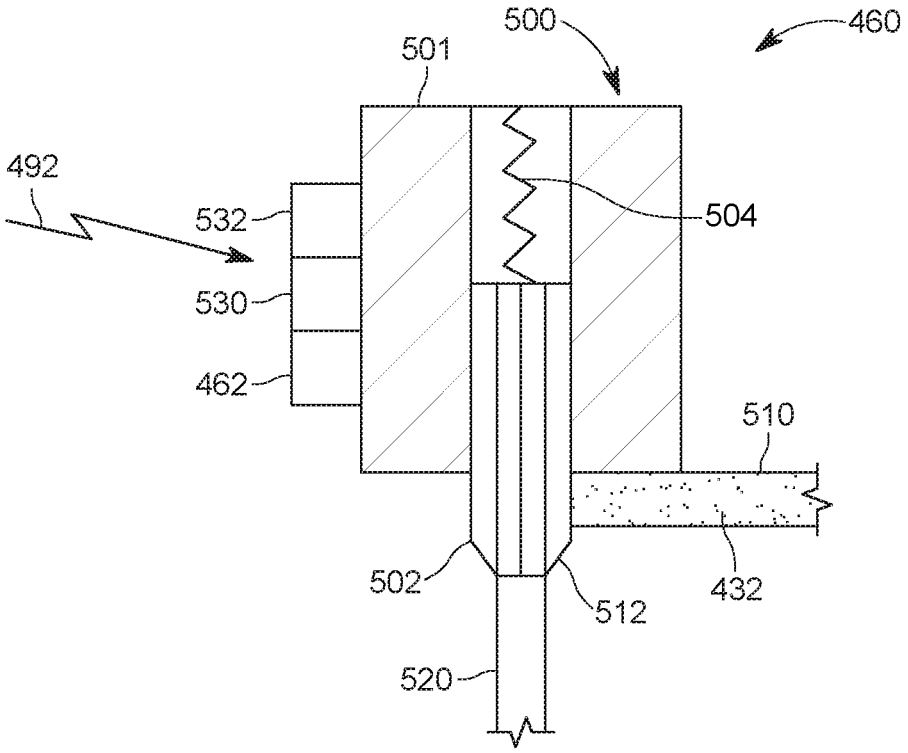
FIGS. 5A and 5B illustrate an implementation of the actuated valve with a solenoid valve.
Figure 5B:
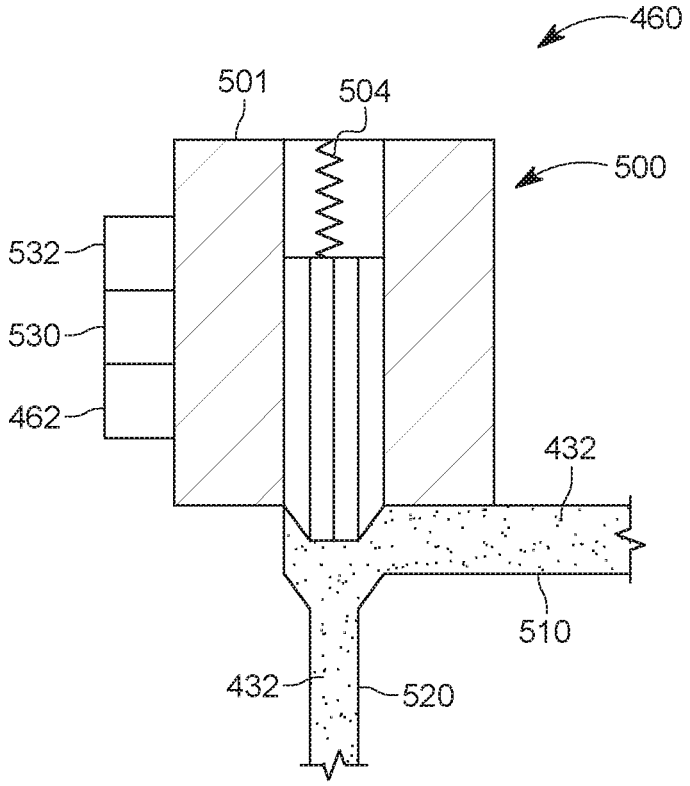

If the global controller 494 determines that the peak pressure of the actuated valve 460 needs to be changed, it will send the signal 492 to the actuated valve to implement this change. One possible implementation of the actuated valve 460 is shown in FIGS. 5A and 5B. FIG. 5A shows the actuated valve 460 being closed and FIG. 5B shows the actuated valve 460 being open.

The actuated valve 460 has an actuation mechanism 500 (a solenoid 501 in this example) that houses a pin 502. The pin 502 may be attached to the solenoid 501 with a spring 504. The actuated valve has an inlet 510 and an outlet 520. A seat 512 is formed between the inlet and the outlet so that the pin 502 fits inside the seat and blocks the flow of the oil 432 from the inlet to the outlet. The receiver 462 may be attached to the actuated valve together with a local controller 530 (e.g., a processor) and a power source 532. The power source is connected to the solenoid and is configured to provide an electrical current to the solenoid, to generate a magnetic field. The magnetic field interacts with the magnetic field produced by the pin 502, which was previously magnetized. The magnetic interaction between the magnetic field of the pin and the magnetic field generated by the solenoid makes the pin to move up or down. A result of this magnetic interaction is shown in FIG. 5B, in which the pin has moved up with the solenoid and a fluid communication was established between the inlet 510 and outlet 520.

Note that the local controller 530, depending on the value of the signal 492, determines to electrically connect the power source 532 to the solenoid 501 to open the pin 502. Thus, with this implementation, the global controller 494 instructs the local controller 530 when to open/close the actuated valve 460.

Figure 6:
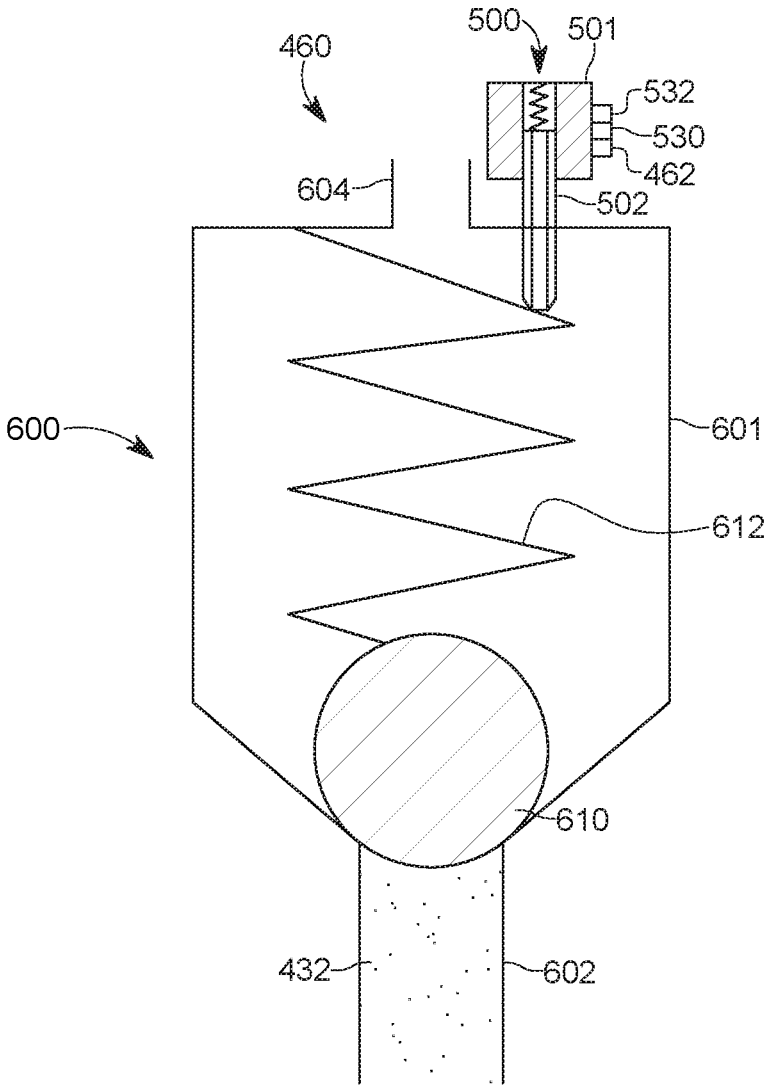
FIG. 6 illustrates an implementation of the actuated valve with a check valve and a solenoid valve.

In another embodiment illustrated in FIG. 6, the actuated valve 460 is implemented as a combination of a check valve 600 and an actuation mechanism 500 (a solenoid valve in this case). The check valve 600 has a housing 601 that accommodates a ball 610 and a biasing mechanism 612 (e.g., a spring). The biasing mechanism 612 presses the ball 610 against an inlet 602, so that the oil 432 cannot enter inside the check valve. When the pressure of the oil overcomes the peak pressure of the check valve 600, the spring 612 is pressed by the ball 610 and the oil enters inside the valve and then exits through an outlet 604. As discussed with regard to FIG. 3, the peak pressure associated with the biasing mechanism 612 is preset.

However, by adding a solenoid valve 500, similar to that described in FIGS. 5A and 5B, it is possible to use the pin 502 to act on the biasing mechanism 612 to either apply more bias or less bias, which results in a modification of the peak pressure. Thus, by receiving at the receiver 462 the signal 492 from the global controller 494, the local controller 430 may be programmed to adjust the amount of bias added by the pin 502 to the biasing mechanism 612, to adjust accordingly the set peak pressure.

In this regard, in one application, it is possible to control the amount of biased applied by the pin 502 to the biasing mechanism 612 so that the check valve 600's flow is controlled. In other words, while in one embodiment the check valve is controlled by solenoid valve 500 to be on or off, in this application, the solenoid valve 500 controls the flow area between the ball 610 and inlet 602, giving a smaller or larger flow of oil as demanded by the engine.

Figure 7A:
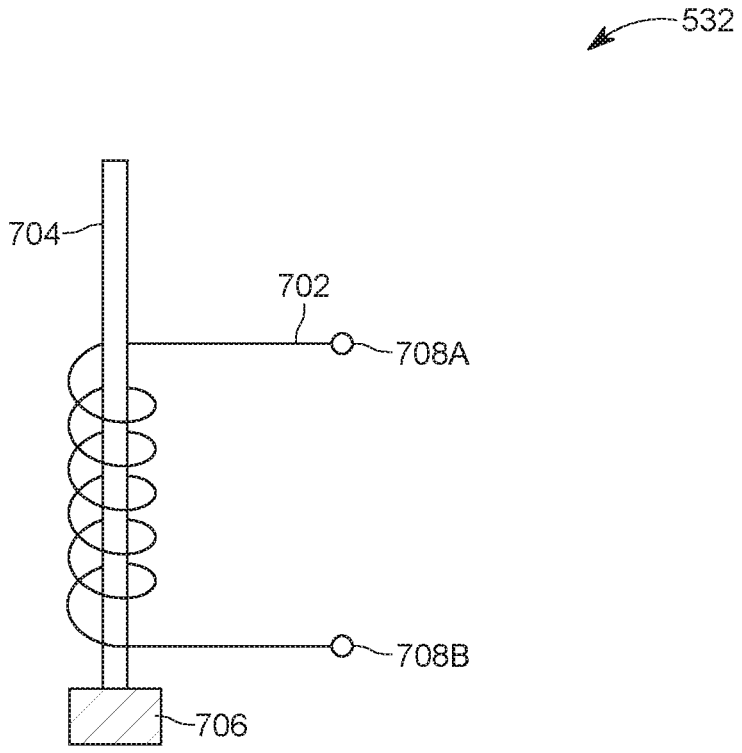
FIGS. 7A and 7B illustrate a linear power generator to be used with the actuated valve for supplying power.
Figure 7B:
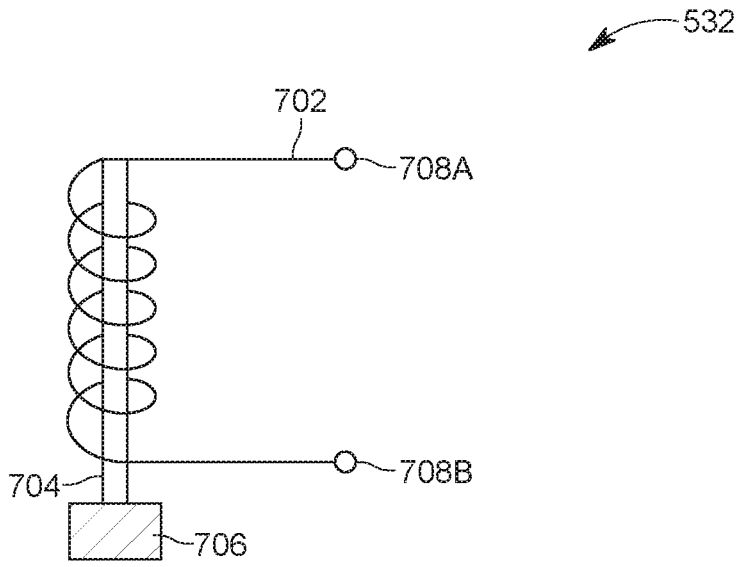

The power source 532 may be implemented in various ways. In one application, the power source is a small rechargeable battery. In another application, the power source is a linear electric generator as illustrated in FIGS. 7A and 7B. FIG. 7A shows a coil 702 in which a rod 704 is located. The rod 704 has at al least one end a mass 706. Because the power source 532 is placed on the telescopic piston, which moves up and down inside the engine, the mass 706 would also move up and down during the various strokes, which make the rod 704 to move up and down inside the coil 702 as shown in FIGS. 7A and 7B. This movement induces an electrical current which can be harvested at pads 708A and 708B as electrical energy. In still another embodiment, the battery is recharged by the linear actuator.

While the previous embodiments were discussed with regard to an active wireless communication between the transmitter 494 and a receiver 462, it is also possible to use a passive receiver that is tuned to the frequency of the transmission signal 492. Thus, it would be possible to power the actuated valve 460 by the transmission signal 492, and for this configuration, no power source 532 or controller 530 would be needed. The activation of the receiver 462 could still be synchronized to the telescopic piston's motion and thus, use of the large forces in the telescopic piston may be implemented to control the oil flow with either positive or negative forces.

An extended implementation of one or more of the above embodiments would be to use the two oil chambers 430 and 448. The volumes of these two oil chambers will experience pressure with opposite signs, i.e., when the upper oil chamber 430 get increased pressure due to a force, the lower oil chamber 448 will get a reduced pressure. With the two chambers, it is possible to install actuated check valves for both. This will offer increased controllability to the entire system.

In comparison to other VCR systems, the controlled telescopic piston system 400 shows one or more advantages as now discussed. In one application, there is no need to change the main components of an engine. The engine block, crankshaft and cylinder head can all remain the same. To implement the system 400, it would be needed to replace the piston and possibly the connecting rod. This means that expensive modifications of the current engine architecture can be avoided. It also means that the controlled telescopic piston can be implemented in current generation engines, and there is no need to wait until the next generation will be introduced.

In another application, it is possible that the compression ratio is adjusted for each cylinder individually. This is very useful if combustion concepts will be used that rely on controlled temperature levels. One such example is Homogeneous Charge Compression Ignition, HCCI.

In still another application, it is possible that the control actuation can be made very fast with the actuated valve (i.e., a controlled check valve). The forces in the piston are very large and this gives very fast actuation. In principle, the entire upper oil chamber 430 can be emptied in one stroke. This fast control is not possible with most other VCR systems.

Figure 8:
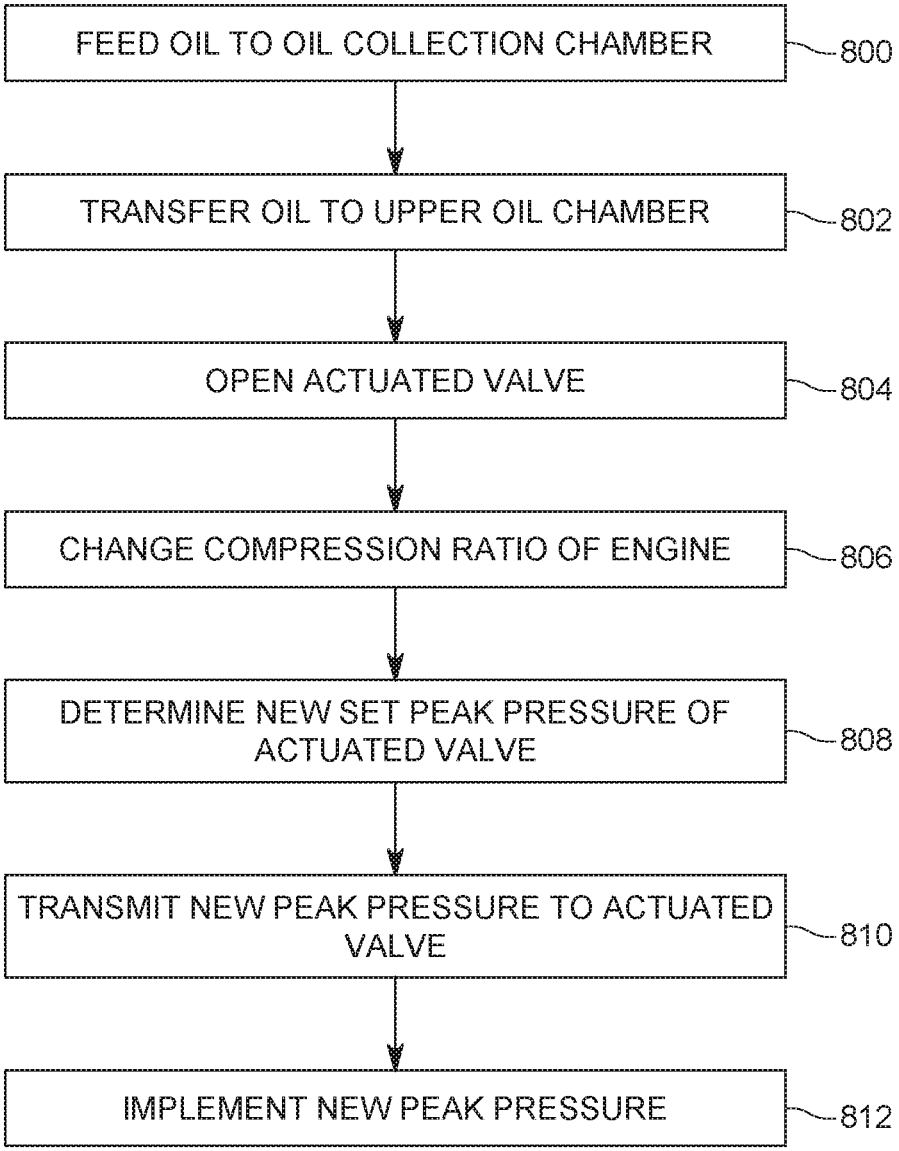
FIG. 8 is a flowchart of a method for operating a variable compression ratio piston having a controllable peak pressure.

A method for running an engine with such a controlled telescopic piston system 400 is now discussed with regard to FIG. 8. In step 800, engine oil from the crank pin lubrication reservoir 472 is used to feed an oil collection chamber 438. A pump 473 (see FIG. 4) may be used to transfer the oil from the reservoir 472, along the passage 434, to the oil collection chamber 438. From here, in step 802, oil 452 is moved to the upper oil chamber 430, which is formed between the inner and outer pistons of the telescopic piston. In step 804, a pressure inside the upper oil chamber 430 becomes higher than a set peak pressure, which makes the actuated valve 460, located in the inner piston 410, to open and allow drainage of the oil from the upper oil chamber 430 back to the reservoir 472. When the oil drains, the outer piston moves in step 806 closer to the inner piston, thus changing a compression ratio of the piston. If the engine is operated with a low inlet pressure or the combustion is late in the cycle, the peak pressure will be low. Hence, the telescopic piston can increase in height and the compression ratio will be increased as the actuated valve will not open. But once the peak pressure during the cycle is reaching the preset peak value, for instance 70 bar, the actuated valve starts to open for part of the cycle and the compression ratio is stabilized. Should the inlet pressure increase, or combustion happens earlier in the cycle, the peak pressure will increase and the oil leakage over the actuated valve will increase, thus reducing the compression ratio.

However, if the operation conditions of the engine change so that the preset peak value of the pressure is not adequate, the global controller can adjust the peak value. For this to happen, one or more sensors 498 measures a pressure P2 inside the cylinder and another sensor 495 measures or determines the crankshaft angle. Based on this information, the global controller 494 makes a decision in step 808 to set a new peak pressure for the actuated valve 460. Those skilled in the art would understand that other mechanisms are available making this decision. For example, the sensor do not need to be an in-cylinder pressure sensor, but a ion-current sensor or knock sensor may be used and this sensor will also give information about combustion, and hence inform the global processed about the need to reduce the compression ratio. In other words, the decision to change the compression ratio may be made based on various information obtained from the engine. The decision to change the peak pressure and set a new peak pressure is sent in step 810, in a wireless manner, from the global controller 494 to a local controller 530 of the actuated valve 460, and in step 812, the local controller 530 implements the new peak pressure at the actuated valve 460.

Figure 9:
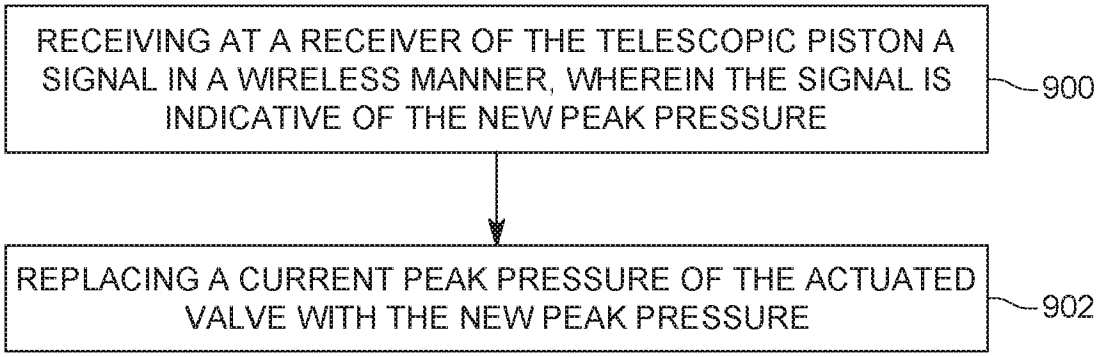
FIG. 9 is a flowchart of a method for adjusting a peak pressure of an actuated valve in a telescopic piston.

A method for adjusting a peak pressure of an actuated valve 460 in a telescopic piston 400 of an engine is now discussed with regard to FIG. 9. The method includes a step 900 of receiving, at a receiver 462 of the telescopic piston 400, a signal in a wireless manner, where the signal is indicative of the new peak pressure, and a step 902 of replacing a current peak pressure of the actuated valve 460 with the new peak pressure. The method may further include a step of determining the new peak pressure with a global controller based on a measured pressure around the telescopic piston and a crankshaft angle, and/or a step of opening the actuated valve to allow oil flow between (1) an upper oil chamber formed between an inner piston and an outer piston of the telescopic piston, and (2) an oil reservoir of the engine so that a compression ratio of the engine is changed.

The disclosed embodiments provide an engine that uses wireless control for an actuated valve for a variable compression ratio piston. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

REFERENCES

[1] Boggs, D., H. Hilbert, and M. Schechter, "The Otto-Atkinson Cycle Engine-Fuel Economy and Emissions Results and Hardware Design," SAE International, SAE Technical Paper 950089, Feb. 1, 1995: p. 220-232;

[2] Roberts, M., "Benefits and Challenges of Variable Compression Ratio (VCR)," Mar. 3, 2003, SAE International, SAE, Technical Paper 2003-01-0398

[3] Ashley, C., "Variable Compression Pistons," Aug. 1, 1990, SAE International, SAE Technical Paper 901539

What is claimed is:

1. A telescopic piston for use with an internal combustion engine, the telescopic piston comprising:
an inner piston;
an outer piston located over the inner piston;
an upper oil chamber formed between the inner piston and the outer piston; and
an actuated valve having a wireless receiver configured to receive a controllable peak pressure that electrically opens the actuated valve,
wherein a value of the peak pressure is wirelessly received at the wireless receiver of the telescopic piston during operation of the telescopic piston.

2. The telescopic piston of claim 1, wherein the actuated valve is located in the inner piston and the actuated valve includes an actuation mechanism.

3. The telescopic piston of claim 2, wherein the actuation mechanism is a solenoid.

4. The telescopic piston of claim 2, wherein the actuation mechanism further includes the wireless receiver.

5. The telescopic piston of claim 4, wherein the actuation mechanism further includes a processor and a power source.

6. The telescopic piston of claim 2, wherein the actuation mechanism includes a solenoid and a check valve.

7. The telescopic piston of claim 6, wherein the solenoid has a pin that acts on a spring of the check valve to change the peak pressure from stroke to stroke.

8. The telescopic piston of claim 2, wherein the actuation mechanism actuates the actuated valve based on a signal received from a transmitter located in an engine associated with the telescopic piston.

9. The telescopic piston of claim 2, wherein the actuation mechanism opens the actuated valve when a pressure of an oil in the upper oil chamber is larger than the peak pressure.

10. An internal combustion engine comprising:
a wireless transmitter;
a cylinder; and
a telescopic piston located inside the cylinder, the telescopic piston having an actuated valve, the actuated valve having a wireless receiver configured to receive a controllable peak pressure that electrically opens the actuated valve,
wherein the controllable peak pressure is received wirelessly from the wireless transmitter, during operation of the telescopic piston.

11. The engine of claim 10, wherein the telescopic piston comprises:
an inner piston;
an outer piston located over the inner piston;
an upper oil chamber formed between the inner piston and the outer piston; and
the actuated valve having the controllable peak pressure that opens the actuated valve.

12. The engine of claim 11, wherein the actuated valve is located in the inner piston and the actuated valve includes an actuation mechanism.

13. The engine of claim 12, wherein the actuation mechanism is a solenoid.

14. The engine of claim 12, wherein the actuation mechanism further includes the wireless receiver.

15. The engine of claim 10, further comprising:
a global controller located on the engine; and
a local controller located on the actuated valve.

16. The engine of claim 15, further comprising:
a pressure sensor located in the cylinder and configured to measure a pressure exerted on the telescopic piston; and
an angle sensor that measures a crankshaft angle,
wherein the crankshaft angle describes a position of a crankshaft, which is connected to the telescopic piston.

17. The engine of claim 16, wherein the global controller determines a new value of the peak pressure based on readings from the pressure sensor and the angle sensor, and sends wirelessly the new peak pressure to the actuated valve.

18. A method for adjusting a peak pressure of an actuated valve in a telescopic piston of an engine, the method comprising:
receiving, during an operation of the telescopic piston, at a wireless receiver of the telescopic piston, a signal in a wireless manner, wherein the signal is indicative of the new peak pressure;
replacing a current peak pressure of the actuated valve with the new peak pressure; and
electrically actuating the actuated valve based on the received signal.

19. The method of claim 18, further comprising:
determining the new peak pressure with a global controller based on a measured pressure around the telescopic piston and a crankshaft angle.

20. The method of claim 18, further comprising:
opening the actuated valve to allow oil flow between (1) an upper oil chamber formed between an inner piston and an outer piston of the telescopic piston, and (2) an oil reservoir of the engine so that a compression ratio of the engine is changed.

21. The method of claim 18, further comprising:
controlling an amount of oil that flows through the actuated valve.

* * * * *